United States Patent [19]

Tomisawa

[11] Patent Number: 4,850,326

[45] Date of Patent: Jul. 25, 1989

[54] APPARATUS FOR LEARNING AND CONTROLLING AIR/FUEL RATIO IN INTERNAL COMBUSTION ENGINE

[75] Inventor: Naoki Tomisawa, Isesaki, Japan

[73] Assignee: Japan Electronic Control Systems, Co., Ltd., Isesaki, Japan

[21] Appl. No.: 97,682

[22] Filed: Sep. 17, 1987

[30] Foreign Application Priority Data

Oct. 21, 1986 [JP] Japan ..... 61-248315
Oct. 21, 1986 [JP] Japan ..... 61-160057[U]

[51] Int. Cl.[4] ..... F02D 41/14; F02D 41/34
[52] U.S. Cl. ..... 123/489
[58] Field of Search ..... 123/440, 489

[56] References Cited

U.S. PATENT DOCUMENTS 4,615,319 10/1986 Tomisawa .
4,655,188 4/1987 Tomisawa et al. .
4,715,344 12/1987 Tomisawa ..... 123/489
4,726,344 2/1988 Ando et al. ..... 123/489 X
4,729,359 3/1988 Tomisawa et al. ..... 123/489 X

FOREIGN PATENT DOCUMENTS 106826 9/1976 Japan .
13130 1/1983 Japan .
27819 2/1983 Japan .
10764 1/1984 Japan .
203828 11/1984 Japan .
203829 11/1984 Japan .
211738 11/1984 Japan .
211742 11/1984 Japan .
90944 5/1985 Japan .
93143 5/1985 Japan .

*Primary Examiner*—Tony M. Argenbright
*Attorney, Agent, or Firm*—Sandler & Greenblum

[57] ABSTRACT

An apparatus for learning and controlling an air/fuel ratio in an engine having an air/fuel feedback control function wherein a fuel injection quantity Ti is computed by correcting a basic fuel injection quanity Tp by a feedback correction coefficient LAMBDA based on a detected air/ful ratio. Deviation of LAMBDA from a reference value during feedback control is determined to further determine a learning correction coefficient. Upon computation of Ti, Tp is corrected by a learning coefficient. A base air/fuel ratio obtained from Ti computed without correction by LAMBDA is made based on a desired air/fuel ratio. During feedback control, Ti is computed by further correcting the air/fuel ratio by LAMBDA. The learning correction coefficient is divided into an indiscriminate learning correction coefficient $K_{ALT}$ for learning deviation by the change of the air density with respect to all the areas of the engine driving state and an area-wise learning correction coefficient $K_{MAP}$ for learning the deviation by dispersion of a part for the respective area. Ti is computed according to Tp, LAMBDA, $K_{ALT}$ and $K_{MAP}$. Where only the deviation by the change of the air density can be learned, the deviation is indiscriminately learned and $K_{ALT}$ is rewritten. In the other regions, the deviation by dispersion of a part is learned for the respective areas and $K_{MAP}$ is rewritten.

13 Claims, 11 Drawing Sheets

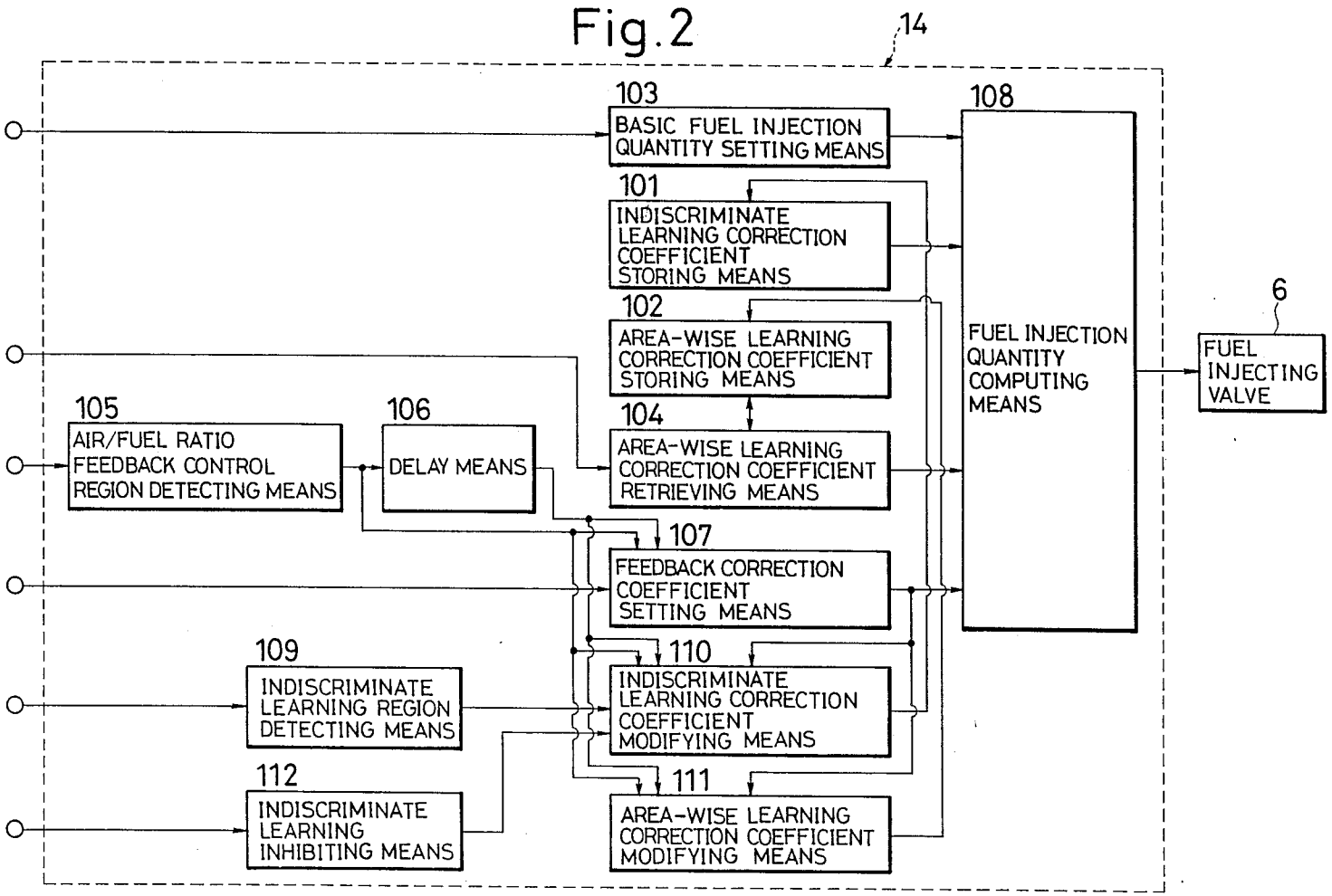
Fig. 2
14
6
FUEL INJECTING VALVE
108
FUEL INJECTION QUANTITY COMPUTING MEANS
103
BASIC FUEL INJECTION QUANTITY SETTING MEANS
101
INDISCRIMINATE LEARNING CORRECTION COEFFICIENT STORING MEANS
102
AREA-WISE LEARNING CORRECTION COEFFICIENT STORING MEANS
104
AREA-WISE LEARNING CORRECTION COEFFICIENT RETRIEVING MEANS
107
FEEDBACK CORRECTION COEFFICIENT SETTING MEANS
110
INDISCRIMINATE LEARNING CORRECTION COEFFICIENT MODIFYING MEANS
111
AREA-WISE LEARNING CORRECTION COEFFICIENT MODIFYING MEANS
106
DELAY MEANS
105
AIR/FUEL RATIO FEEDBACK CONTROL REGION DETECTING MEANS
109
INDISCRIMINATE LEARNING REGION DETECTING MEANS
112
INDISCRIMINATE LEARNING INHIBITING MEANS EVERY 10ms
PROPORTIONAL · INTEGRATING CONTROL ROUTINE
S31
λ cont FLAG ?
0
1
S32
READING-IN OF OUTPUT VOLTAGE $V_{O2}$ OF $O_2$ SENSOR
S33
$V_{O2}$ : $V_{ref}$
>
<
RICH
LEAN
S34
REVERSION ?
YES
NO
S35
LAMBDA←LAMBDA+P
S36
LAMBDA←LAMBDA+I
S37
REVERSION ?
YES
NO
S38
LAMBDA←LAMBDA−P
S39
LAMBDA←LAMBDA−I
END

APPARATUS FOR LEARNING AND CONTROLLING AIR/FUEL RATIO IN INTERNAL COMBUSTION ENGINE

BACKGROUND OF THE INVENTION (1) Field of the Invention

The present invention relates to an apparatus for learning and controlling air/fuel ratio in an automobile internal combustion engine having an electronically controlled fuel injection apparatus with an air/fuel ratio feedback control function. More specifically, the present invention relates to an apparatus for controlling and learning the air/fuel ratio, which apparatus can cope with the change in air density caused by change in altitude.

(2) Description of the Related Art

An apparatus for learning and controlling the air/fuel ratio, as disclosed in the specification of U.S. Pat. No. 4,615,319, is incorporated into an automobile having an internal combustion engine having an electronically controlled fuel injection apparatus with an air/fuel ratio feedback control function.

In the control system, a basic fuel injection quantity calculated from a parameter of an engine driving state, which participates in the quantity of air sucked in an engine, is corrected by a feedback correction coefficient set by a proportional-integrating control based on a signal from an air/fuel ratio sensor, such as an $O_2$ sensor, disposed in the exhaust system of the engine to compute a fuel injection quantity. The air/fuel ratio is feedback-controlled to an aimed air/fuel ratio, according to the above-mentioned conventional technique, and the deviation of the feedback correction coefficient from a reference value during the feedback control of the air/fuel ratio is learned for respective predetermined areas of the engine driving state in order to determine a learning correction coefficient. In computing the fuel injection quantity, the basic fuel injection quantity is corrected by the learning correction coefficient for each area so that the basic air/fuel ratio obtained by the fuel injection quantity computed without correction by the feedback correction coefficient comes to agree with desired air/fuel ratio, and during feedback control of the air/fuel ratio, this is further corrected by the feedback correction coefficient to compute the fuel injection quantity.

According to this conventional technique, during the feedback control of the air/fuel ratio, follow-up delay of the feedback control can be prevented during transient driving, and the desired air/fuel ratio can be precisely obtained when feedback control of the air/fuel ratio stops.

Furthermore, there is known system where the basic fuel injection quantity Tp is determined from the throttle valve opening degree $\alpha$ and the engine rotation number N, for example, the sucked air flow quantity Q is determined from $\alpha$ and N by referring to a map and Tp is computed according to the formula of $Tp=K\cdot Q/N$(K is a constant). There is also known system where the sucked air flow quantity Q is detected by an air flow meter and the basic fuel injection quantity is computed from the flow quantity Q and the engine rotation number N according to the formula of $Tp=K\cdot Q/N$. In a case where a flap type air flow meter (volume flow rate-detecting type) is used as the flow meter, the change in air density is not reflected in computation of the basic fuel injection quantity, but if the above-mentioned learning control is performed, the computation can cope with change in air density due to changes in altitude or temperature of sucked air, insofar as learning is advanced in a good condition.

However, in the case where an automobile abruptly ascends to an upland (mountain) from a low land, since the ascending driving is a kind of transient driving, according to the system where learning is performed for the respective areas of the engine driving state, the area for learning is not fixed and even if learning is possible, learning-possible areas are limited while learning is hardly advanced in the majority of areas. Accordingly, in case of the ordinary driving or re-starting of the engine at a flat ground in the vicinity of the summit of the mountain, because of the control delay in the air/fuel ratio feedback control, an over-rich state in the air/fuel mixture gas is produced. This over-rich state is also produced because of large deviation of the basic air/fuel ratio from the desired air/fuel ratio at the stoppage of the air/fuel ratio feedback control. Occurrence of this over-rich state causes various difficulties such as reduction in drivability, engine stalling and difficulty in starting.

The reason is as follows. Although it is necessary to learn and correct the change of the density of air from the deviation of the feedback correction coefficient from the reference value during the air/fuel ratio feedback control, since the learned deviation includes the deviation of the basic air/fuel ratio which depends on dispersion of parts such as a fuel injecting valve or a throttle body, and since this deviation cannot be separated from deviation due to the change of the air density, the deviation corresponding to the change of the air density, which can be inherently indiscriminately learned, should be learned for respective areas of the driving state of the engine. In a case where the automobile abruptly ascends to an upland, learning for the respective areas is impossible and learning is not substantially advanced.

The premise of learning is that the air/fuel ratio feedback control is carried out. However, in conventional techniques, the air/fuel ratio feedback control is carried out only in the low-rotation low-load region (inclusive of the medium-rotation medium-load region) set as the air/fuel ratio feedback control region. The reason is that if the feedback control to the theoretical air/fuel ratio, that is, the desired air/fuel ratio, is carried out in the high-rotation or high-load region, there is a risk of seizure of the engine or burning of the catalyst by elevation of the temperature. Therefore, in this region, the feedback correction coefficient is clamped and a rich output air/fuel ratio is separately obtained to prevent seizure of the engine.

Accordingly, when the automobile ascends a mountain, the driving is performed mainly in the high-load region and the air/fuel ratio feedback control is hardly performed and, hence, learning is not substantially carried out. This is another reason why the deviation corresponding to the change in air density cannot be promptly learned.

SUMMARY OF THE INVENTION

It is a primary object of the present invention to solve the foregoing problems of the conventional techniques and provide an apparatus for learning and controlling the air/fuel ratio in an internal combustion engine, in which the deviation corresponding to the change of the air density can be learned at a high speed and the air/fuel ratio can be well learned and controlled even when driving up mountains or the like.

In order to attain this object, according to the present invention, the learning correction coefficient is divided into an indiscriminate learning correction coefficient for indiscriminately learning the deviation corresponding to the change of the air density mainly for correction of the deviation due to the altitude and into an area-wise learning correction coefficient for learning the deviation depending on dispersion of a part or the like for the respective areas of the engine driving state. Under conditions where only the deviation corresponding to the change of the air density can be learned, that is, in the region where the deviation of the system by the change of the opening degree of the throttle valve is not caused and the sucked air flow quantity is hardly changed by change in degree of openness of the throttle valve at each engine rotation number, the deviation corresponding to the change of the air density is indiscriminately learned and the indiscriminate learning correction coefficient is rewritten. In the other region, the deviation depending on dispersion of a part of the like is learned for the respective areas and the area-wise learning correction coefficient is rewritten.

More specifically, in accordance with the present invention, there is provided an apparatus for learning and controlling the air/fuel ratio in an internal combustion engine, which comprises:

(A) engine driving state detecting means for detecting an engine driving state including at least one parameter having an impact upon quantity of air sucked into the engine;

(B) air/fuel ratio detecting means for detecting an exhaust component of the engine and detecting air/fuel ratio of an air/fuel mixture sucked into the engine;

(C) basic fuel injection quantity setting means for setting the basic fuel injection quantity based on the parameter detected by the engine driving state detecting means;

(D) rewritable indiscriminate learning correction coefficient storing means which stores therein an indiscriminate learning correction coefficient for indiscriminately correcting the basic fuel injection quantity for all areas of the engine driving state;

(E) rewritable area-wise learning correction coefficient storing means which stores therein an area-wise learning correction coefficient for correcting the basic fuel injection quantity for the respective areas of the engine driving state;

(F) area-wise learning correction coefficient retrieving means for retrieving an area-wise learning correction coefficient of the corresponding area of the engine driving state from the area-wise learning correction coefficient storing means based on the actual engine driving state;

(G) feedback correction coefficient setting means for comparing the air/fuel ratio detected by the air/fuel ratio detecting means with a desired air/fuel ratio and then increasing or decreasing by a predetermined quantity a feedback correction coefficient for correcting the basic fuel injection quantity to bring the actual air/fuel ratio close to the desired air/fuel ratio;

(H) fuel injection quantity computing means for computing the fuel injection quantity based on the basic fuel injection quantity set by the basic fuel injection quantity setting means, the indiscriminate learning correction coefficient stored in the indiscriminate learning correction coefficient storing means, the area-wise learning correction coefficient retrieved by the area-wise learning correction coefficient retrieving means and the feedback correction set by the feedback correction coefficient setting means;

(I) fuel injection means for injecting and supplying a fuel to the engine in an on-off manner according to a driving pulse signal corresponding to the fuel injection quantity computed by the injection quantity computing means;

(J) indiscriminate learning region detecting means for detecting a predetermined region where the sucked air flow quantity is not substantially changed according to the change in the degree of openness of the throttle valve at each engine rotation number;

(K) indiscriminate learning correction coefficient modifying means for, on detection of the predetermined region by the indiscriminate learning region detecting means, learning the deviation of the feedback correction coefficient from the reference value and modifying and rewriting the indiscriminate learning correction coefficient of the indiscriminate learning correction coefficient storing means so as to reduce the deviation; and (L) area-wise learning correction coefficient modifying means for, on non-detection of the predetermined region by the indiscriminate learning region detecting means, learning the deviation of the feedback correction coefficient from the reference value for the respective areas of the engine driving state and modifying and rewriting the area-wise learning correction coefficient of the area-wise learning correction coefficient storing means so as to reduce the deviation.

Namely, the basic fuel injection quantity setting means sets the basic fuel injection quantity corresponding to the aimed air/fuel ratio based on the parameter participating in the quantity of air sucked in the engine. The area-wise learning correction coefficient retrieving means retrieves the area-wise learning correction coefficient of the area corresponding to the actual engine driving state from the area-wise learning correction coefficient storing means. The feedback correction coefficient setting means compares the actual air/fuel ratio with the aimed air/fuel ratio and increases or decreases by a predetermined quantity and sets the feedback correction coefficient to bring the actual air/fuel ratio close to the aimed air/fuel ratio. The fuel injection quantity computing means corrects the basic fuel injection quantity by the indiscriminate learning correction coefficient stored in the indiscriminate learning correction coefficient storing means, by the area-wise learning correction coefficient and further by the feedback correction coefficient and computes the fuel injection quantity. The fuel injection means is actuated by a driving pulse signal corresponding to this fuel injection quantity.

The indiscriminate region detecting means detects whether or not the region is a predetermined region where the sucked air flow quantity is not substantially changed according to the change of the opening degree of the throttle valve at each engine rotation number. In the case where said predetermined region is detected, the deviation of the feedback correction coefficient from the reference value is learned by the indiscriminate learning correction coefficient modifying means, and the indiscriminate learning correction coefficient is modified so as to reduce this deviation and the data in the indiscriminate learning correction coefficient storing means is rewritten. Thus, under conditions where only the deviation corresponding to the change of the air density can be learned, that is, in the region where the deviation of the system by the change of the opening degree of the throttle valve is not caused and the sucked air flow quantity is hardly changed by the change of the opening degree of the throttle valve at each engine rotation number, the deviation by the change of the air density is preferentially learned indiscriminately. Incidentally, it is not always true that in this region, any deviation by dispersion of a part or the like is not present, but since the opening degree of the throttle valve is high and the main deviation by dispersion of a part, that is, the deviation of the pule width-injection flow quantity of the fuel injection valve or the deviation of the intake quantity characteristic by the opening degree of the throttle valve, is much smaller than in the region where the opening degree of the throttle valve is low, and this deviation can be learned while it is absorbed in the deviation by the change of the air density.

In case of the region other than the above-mentioned predetermined region, by the area-wise learning correction coefficient modifying means, the deviation of the feedback correction coefficient from the reference value is learned for the respective areas of the engine driving state and the area-wise learning correction coefficient corresponding to the area of the engine driving state is modified to reduce the deviation and rewrites the data of the area-wise learning correction coefficient storing means is rewritten. Thus, the deviation by dispersion of a part or the like is learned for the respective areas.

Incidentally, the basic fuel injection quantity setting means estimates the sucked air flow quantity, for example, from the opening degree of the throttle valve and the engine rotation number and sets the basic fuel injection quantity from this sucked air flow quantity and the engine rotation number. However, there may be adopted a method in which the sucked air flow quantity is directly detected. The storing areas of the area-wise learning correction coefficient storing means are sorted, for example, based on the engine rotation number and the basic fuel injection quantity, but other parameters may be used. The indiscriminate learning region detecting means retrieving a comparison value of, for example, the opening degree of the throttle valve determined according to the engine rotation number, compares the actual opening degree of the throttle valve with the comparative value and detects the indiscriminate learning region when the actual opening degree of the throttle valve is larger than the comparative value. It is sufficient if the indiscriminate learning region detecting means can detect the predetermined region where the sucked air flow quantity is not substantially changed by the change of the opening degree of the throttle valve at each engine rotation number.

Furthermore, the present invention provides additional structural elements for learning the deviation by the change of the air density more precisely.

In the case where the present invention is applied to a single-point injection system comprising common fuel injection means for all the cylinders, which is arranged in a collective portion of intake passages of the engine, in the region where the opening degree of the throttle valve is very large, the flow rate of sucked air is reduced and distribution of fuel into the respective cylinders is worsened, and the air/fuel ratio becomes uneven among the respective cylinders, with the result that it becomes impossible to precisely learn the deviation by the change of the air density. In the above-mentioned system, since the distance between the fuel injection means and the combustion chamber of each cylinder is long, the air/fuel ratio in each cylinder is disturbed by the influence of fuel flowing on the wall during high acceleration and precise learning of the deviation by the change of the air density becomes impossible.

Accordingly, the following means (M) is disposed in addition to the above-mentioned means (A) through (L):

(M) indiscriminate learning inhibiting means for inhibiting the learning by the indiscriminate learning correction coefficient modifying means in a predetermined engine driving state.

Thus, even in the region where the sucked air flow quantity is not substantially changed by the change of the opening degree of the throttle valve at each engine rotation number, the learning of the indiscriminate learning correction coefficient is inhibited in the distribution-worsening region predetermined by the engine rotation number and the opening degree of the throttle valve and in the predetermined engine driving state continuing for a predetermined time after the acceleration, whereby the accuracy of learning is increased.

Furthermore, the present invention provides an additional structural element for increasing the opportunity of learning of the deviation by the change of the air density in the system where the low-rotation low-load region is set as the air/fuel ratio feedback control region.

Namely, even if the air/fuel ratio feedback control region which is the low-rotation low-load region shifts to the region where the feedback control of the air/fuel ratio is not performed, the air/fuel ratio feedback control is continued for a predetermined time so that learning can be performed during this time, whereby the opportunity of learning of the deviation by the change of the air density is increased at the time of mountain climbing or the like.

In this case, with respect to the feedback correction coefficient setting means, indiscriminate learning correction coefficient modifying means and area-wise learning correction coefficient modifying means, it is required that it should be one of the operational conditions that feedback control instructions are being put out, and the following means (N) and (O) are additionally disposed:

(N) air/fuel ratio feedback control region detecting means for discriminating the engine driving state, detecting the air/fuel ratio control which is the low-rotation low-load region and putting out air/fuel ratio feedback control instructions; and (O) delay mans for continuing to put out air/fuel ratio feedback control instructions for a predetermined time when the air/fuel ratio feedback control region to other region.

According to this embodiment, in the case where the air/fuel ratio feedback control region which is the low-rotation low-loaded region shifts to the region where the feedback control of the air/fuel ratio is not performed, air/fuel ratio feedback control instructions are kept put out for a predetermined time by said delay means to perform the air/fuel ratio feedback control by the feedback correction coefficient setting means. If predetermined conditions are satisfied during this predetermined time, learning is performed by the indiscriminate learning correction coefficient modifying means, whereby the opportunity of learning is increased even at the time of mountain climbing or the like and the deviation by the change of the air density can be learned at a high speed.

Incidentally, although the air/fuel ratio feedback control is continued for a predetermined time when the air/fuel ratio feedback control region shifts to the region where the air/fuel ratio feedback control is not performed, the term "predetermined time" used does not absolutely mean "a certain time", but the delay time can be changed according to the circumstance. For example, completion of at least one learning (rewriting of the indiscriminate learning correction coefficient) is inspected, and the air/fuel ratio feedback control is continued until this learning is completed.

The characteristic structural features of the present invention and the functions and effects attained by these features will become apparent from the following detailed description of embodiments.

BRIEF DESCRIPTION OF THE DRAWINGS

FIG. 2 is a function block diagram showing the fuel injection control in the control unit shown in FIG. 1.

DETAILED DESCRIPTION OF THE PREFERRED EMBODIMENTS

Figure 1:
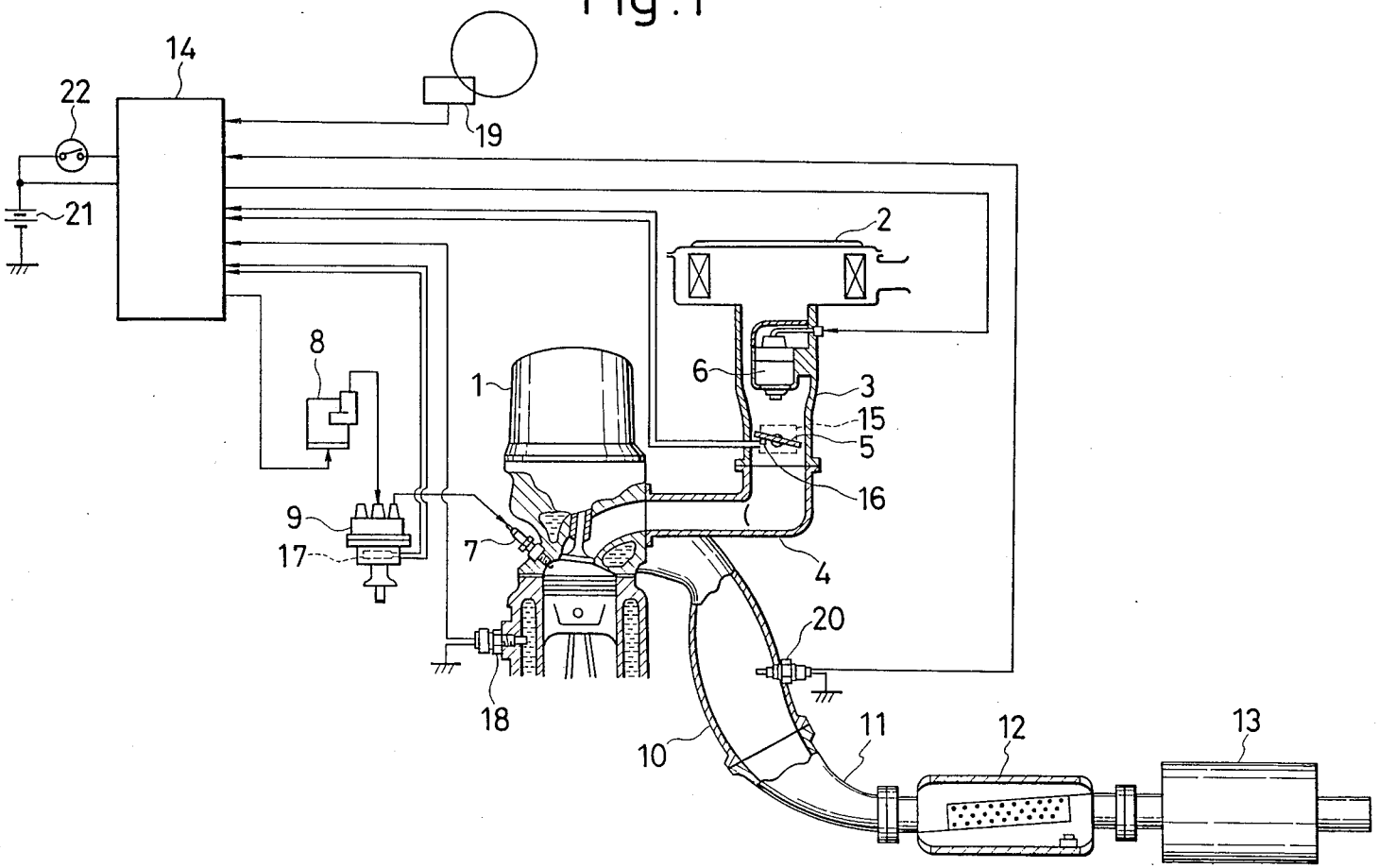
FIG. 1 is a systematic view of an internal combustion engine, which illustrate one embodiment of the present invention.

Referring to FIG. 1, air is sucked into an engine through an air cleaner 2, a throttle body 3 and an intake manifold 4.

In the throttle body 3, a throttle valve 5 interlocking with an accelerating pedal not shown in the drawings is disposed, and a fuel injection valve 6 is arranged as the fuel injecting means upstream of the throttle valve 5. The fuel injection valve 6 is an electromagnetic fuel injection valve which is opened when a solenoid is actuated and is closed when the solenoid is de-energized. Namely, the solenoid is actuated by a driving pulse signal from a control unit 14 described hereinafter to open the fuel injection valve 6, and a compressed fuel fed from a fuel pump not shown in the drawings is injected and supplied while the pressure of the fuel is adjusted to a predetermined level by a pressure regulator. In the present embodiment, a single-point injection system is adopted, but there may be adopted a multi-point injection system in which fuel injection valves are arranged for the respective cylinders in a branching portion of the intake manifold or in an intake port of the engine.

An ignition plug 7 is arranged in a combustion, chamber of the engine 1, and a high voltage generated in an ignition coil 8 based on an ignition signal from the control unit 14 is applied to the ignition plug 7 through a distributor 9 to cause an air/fuel mixture to fire and burn.

An exhaust gas is discharged from the engine 1 through an exhaust manifold 10, an exhaust duct 11, a ternary catalyst 12 and a muffler 13.

The control unit 14 comprises a micro-computer including CPU, ROM, A/D converter and input-output interface, and the control unit 14 receives input signals from various sensors and performs computing processings described hereinafter to control to operations of the fuel injection valve 6 and the ignition coil 8.

As the sensors, there can be mentioned a potentiometer type throttle sensor 15 arranged in the throttle valve 5 to put out a voltage signal corresponding to the opening degree of the throttle valve and an idle switch 16 arranged in the throttle sensor 15, which is turned on when the throttle valve 5 is located at the fully closed position.

A crank angle sensor 17 is built in the distributor 9 to put out position signals by every crank angle of 2° and reference signals by every crank of 180° (in case of a 4-cylinder engine). The engine rotation number N can be calculated by measuring the pulse number of position signals per unit time or the frequency of reference signals.

There are disposed a water temperature sensor 18 for detecting the temperature Tw of engine-cooling water and a car speed sensor 19 for detecting a car speed VSP.

The throttle sensor 15 and crank angle sensor 17 constitute an engine driving state detecting means.

An $O_2$ sensor 20 is arranged in the exhaust manifold 10. This $O_2$ sensor is a known sensor in which the electromotive force abruptly changes at the boundary where the air/fuel mixture is burnt in the vicinity of a theoretical, desired, air/fuel ratio. Accordingly, the $O_2$ sensor 20 acts as the means for detecting the air/fuel ratio (rich or lean).

A battery 21 is connected to the control unit 14 through an engine key switch 22 as a power source for the control unit 14 or as means for detecting the power source voltage. As a power source for the operation of memory elements in the control unit 14, the battery 21 is also connected to the control unit 14 through an appropriate stabilizing power source, not through the engine key switch 22, so that the memory content can be retained even after the engine key switch 22 is turned off.

In the illustrated embodiment, a CPU built in the micro-computer 14 performs computing processings according to programs (fuel injection quantity computing routine, feedback control zone judging routine, proportional-integrating control routine, learning routine, $K_{ALT}$ learning sub-routine, $K_{MAP}$ learning sub-routine and initializing routine stored in a ROM, as shown in the block diagram of FIG. 2, and in the detail flow charts of FIGS. 3 through 9, to control the injection of the fuel.

A summary of the computing processings of the microcomputer in the control unit will now be described with reference to the block diagram of FIG. 2.

Referring to FIG. 2, because it possesses a microcomputer RAM, control unit 14 functions as a rewritable indiscriminate learning correction coefficient storing means 101. This means 101 stores an indiscriminate learning correction coefficient $K_{ALT}$ (the initial value is, for example, 0) which is indiscriminate over all the areas of the engine driving state. Additionally control unit 14 functions as a rewritable area-wise learning correction coefficient storing means 102 which stores an area-wise learning correction coefficient $K_{MAP}$ (the initial value is, for example, 0) for the respective areas of the engine rotation number N and engine load (basic fuel injection quantity Tp) indicating the driving state of the engine.

Furthermore, since the CPU of the micro-computer of the control unit 14 performs computing according to the programs on ROM, the control unit 14 also functions as a basic fuel injection quantity setting means 103, area-wise learning correction coefficient retrieving means 104, air/fuel ratio feedback control region detecting means 105, delay means 106, feedback correction coefficient setting means 107, fuel injection quantity computing means 108, indiscriminate learning region detecting means 109, indiscriminate learning correction coefficient modifying means 110, area-wise learning correction coefficient modifying means 111 and indiscriminate learning inhibiting means 112.

The basic fuel injection quantity setting means 103 sets the basic fuel injection quantity Tp corresponding to the desired air/fuel ratio based on the opening degree $\alpha$ of the throttle valve and the engine rotation number N, which are parameters have an impact upon the quantity of air sucked in the engine.

The area-wise learning correction coefficient retrieving means 104 retrieves the area-wise learning correction coefficient $K_{MAP}$ of the area corresponding to the actual engine driving state (N and Tp) from the area-wise learning correction coefficient storing means 102.

Figure 10:
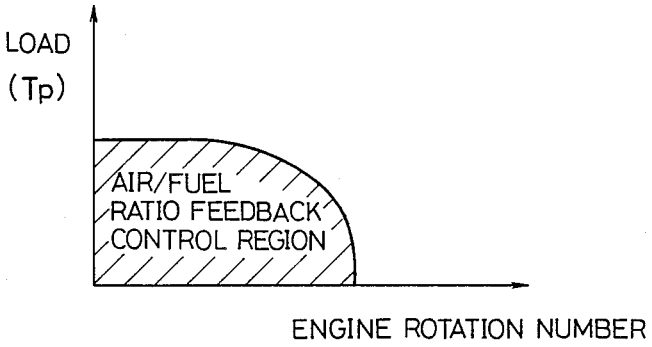
FIG. 10 is a diagram illustrating the air/fuel ratio feedback control region.

The feedback correction coefficient setting means 107 compares the actual air/fuel ratio with the desired air/fuel ration while air/fuel ratio feedback control instructions are output by the air/fuel ratio feedback control region detecting means 105, that is, the low-rotation low-load air/fuel ratio feedback control region hatched in FIG. 10, and sets the feedback correction coefficient LAMBDA (the reference value is, for example, (1) by increasing or decreasing the feedback correction coefficient LAMBDA by a predetermined proportional constant P or by integrating constant I based on the proportional-integrating control so that the actual air/fuel ratio is brought close to the desired air/fuel ratio.

The fuel injection quantity computing means 108 corrects the basic fuel injection quantity Tp by the indiscriminate learning correction coefficient $K_{ALT}$ stored in the indiscriminate learning correction coefficient storing means 101, by the area-wise learning correction coefficient $K_{MAP}$, and further by the feedback correction coefficient LAMBDA, whereby the fuel injection quantity $Ti = Tp \cdot (\text{LAMBDA} + K_{ALT} + K_{MAP})$ is computed. The fuel injection valve 6 as the fuel injection means is operated by a driving pulse signal corresponding to this fuel injection quantity Ti.

Figure 11:
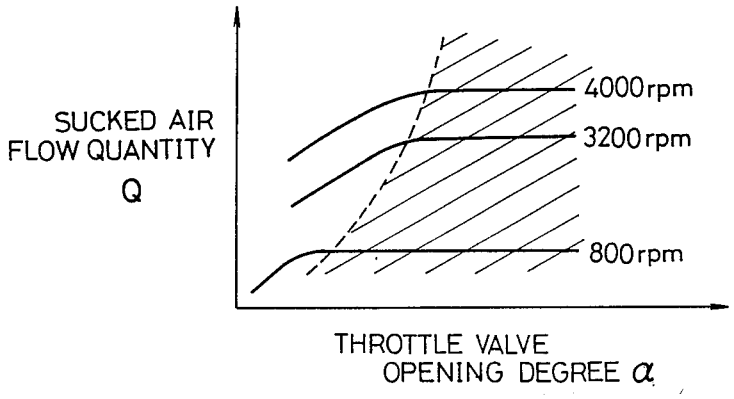
FIG. 11 is a diagram illustrating the learning region for the indiscriminate learning correction coefficient.

The indiscriminate learning region detecting means 109 detects whether or not the region is the predetermined highload region (hereinafter referred to as "Q flat region") where the sucked air flow quantity Q is hardly changed by the change of the throttle valve opening degree $\alpha$, which region is hatched in FIG. 11.

In case of the Q flat region, while the air/fuel ratio feedback control instructions are being output, the deviation $\Delta$LAMBDA of the feedback correction coefficient LAMBDA from the reference value (for example, 1) is learned by the indiscriminate learning correction coefficient modifying means 110, and the indiscriminate learning correction coefficient $K_{ALT}$ is modified to reduce this deviation, whereby the data of the indiscriminate learning correction coefficient storing means 101 rewritten. More specifically, the indiscriminate learning correction coefficient $K_{ALT}$ is renewed by adding a predetermined proportion of the deviation $\Delta$LAMBDA to the present indiscriminate learning correction coefficient $K_{ALT}$ according to the following formula:

$$K_{ALT} \leftarrow K_{ALT} + M_{ALT} \cdot \Delta\text{LAMBDA}$$

wherein $M_{ALT}$ represents the predetermined addition proportion.

In the above-mentioned manner, under conditions where only the deviation by the change of the air density can be learned, that is, in the region where no deviation of the system is caused by the change of the opening degree of the throttle valve 5, the deviation by the change of the air density is preferentially learned indiscriminately.

However, in the single-point injection system, even in the Q flat region, learning of the indiscriminate learning correction coefficient $K_{ALT}$ is inhibited by the indiscriminate learning inhibiting means 112. This holds true in the distribution-worsening region and/or until a predetermined time passes after acceleration (until the wall flow becomes stationary), whereby the accuracy of learning is increased.

In the region other than the above-mentioned Q flat region, while the air/fuel ratio feedback control instructions are being output, the deviation $\Delta$LAMBDA of the feedback correction coefficient LAMBDA from the reference value for the respective areas of the engine rotation number N and basic fuel injection quantity Tp indicating the engine driving state is learned by the area-wise learning correction coefficient modifying means 111, and the area-wise learning correction coefficient $K_{MAP}$ of the area corresponding to the actual engine driving state is modified so that this deviation is reduced and the data of the area-wise learning correction coefficient storing means 102 is rewritten. More specifically, the area-wise learning correction coefficient $K_{MAP}$ is renewed by adding a predetermined proportion of the deviation $\Delta$LAMBDA to the present area-wise learning correction coefficient $K_{MAP}$ according to the following formula:

$$K_{MAP} \leftarrow K_{MAP} + M_{MAP} \cdot \Delta\text{LAMBDA}$$

wherein $M_{MAP}$ represents the predetermined addition proportion.

In the above-mentioned manner, the deviation by dispersion of a part or the like is learned for the respective areas.

In this embodiment, when the air-fuel ratio feedback control region shifts from the low-rotation low-load region to the region where the air/fuel ratio feedback control is not performed, the air/fuel ratio feedback control instructions are delayed for a predetermined time by the delay means 106, and the air/fuel ratio feedback control is performed by the feedback correction coefficient setting means 107. During this period, learning is performed by the indiscriminate learning correction coefficient modifying means, 110 or area-wise learning correction coefficient modifying means 111. Accordingly, the opportunity of learning is increased at the time of mountain climbing or the like and deviation by the change of the air density can be learned at a high speed.

The computing processings by the micro-computer in the control unit 14 will now be described in detail with reference to the flow charts of FIGS. 3 through 9.

Figure 3:
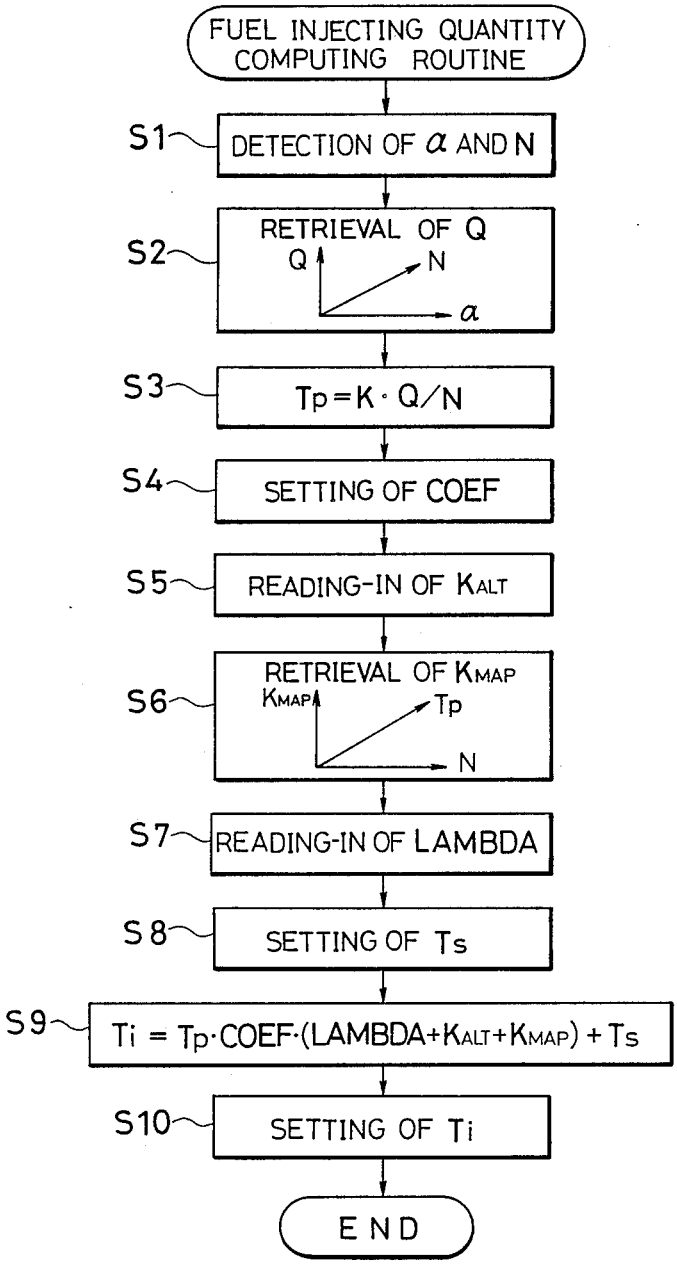
FIG. 3 is a flow chart showing the fuel injection quantity computing routine.

In the fuel injection quantity computing routine shown in FIG. 3, at step 1 (represented by S1 in the drawings; subsequent steps will be similarly represented), the throttle valve opening degree $\alpha$ detected based on the signal from the throttle sensor 15 and the engine rotation number N calculated based on the signal from the crank angle sensor 17 are read in.

At step 2, the sucked air flow quantity Q corresponding to the actual throttle valve opening degree $\alpha$ and engine rotation number N is retrieved and read in the micro-computer with reference to the map on ROM in which values Q corresponding to values $\alpha$ and N, which have been determined in advance by experiments or the like, are stored.

At step 3, the basic fuel injection quantity $Tp=K\cdot Q/N$ (K is a constant) corresponding to the quantity of air sucked in the engine 1 per unit rotation is computed from the sucked air flow quantity Q and the engine rotation number N. The portion of these steps 1 through 3 corresponds to the basic fuel injection quantity setting means.

Various correction coefficient COEF including the ratio of the change of the throttle valve opening degree $\alpha$ detected based on the signal from the throttle sensor 15, the acceleration correction coefficient by on-to-off changeover of the idle switch 16, the water temperature correction coefficient corresponding to the engine-cooling water temperature Tw detected based on the signal from the water temperature sensor 18 and the mixture ratio correction coefficient corresponding to the engine rotation number N and basic fuel injection quantity Tp are set at step 4.

At step 5, the indiscriminate learning correction coefficient $K_{ALT}$ stored at a predetermined address of RAM as the indiscriminate learning correction coefficient storing means is read in. Incidentally, before initiation of learning, the indiscriminate learning correction coefficient $K_{ALT}$ is stored as the initial value of 0, and this initial value is read in.

At step 6, by referring to the map on RAM as the area-wise learning correction coefficient storing means, in which the area-wise learning correction coefficient $K_{MAP}$ corresponding to the engine rotation number N and basic fuel injection quantity Tp indicating the engine driving state is stored, $K_{MAP}$ corresponding to actual N and Tp are retrieved and read in. The portion of this step corresponds to the area-wise correction coefficient retrieving means. In the map of the area-wise learning correction coefficient $K_{MAP}$, the engine rotation number N is plotted on the ordinate and the basic fuel injection quantity Tp is plotted on the abscissa, and the engine driving state is divided into areas by a lattice of about $8\times 8$. The area-wise learning correction coefficient $K_{MAP}$ is stored for each area, and at the point when learning is not initiated, an initial value of 0 is stored for all of the areas.

At step 7, the feedback correction coefficient LAMBDA set by the proportional-integrating control routine shown in FIG. 5, which will be described hereinafter, is read in. Incidentally, the reference value of the feedback correction coefficient LAMBDA is 1.

At step 8, the voltage correction portion Ts is set based on the voltage value of the battery 21 to correct the change of the injection flow quantity of the fuel injection valve due to variation in battery voltage.

At step 9, the fuel injection quantity Ti is computed according to the formula of $Ti=Tp\cdot COEF\cdot(LAMBDA+K_{ALT}+K_{MAP})+Ts$, and the portion of this step corresponds to the fuel injection quantity computing means.

At step 10, computed Ti is set at an output resistor. Thus, at a fuel injection timing synchronous with a predetermined engine rotation number (for example, every $\frac{1}{2}$ rotation), a driving pulse signal having a pulse width of Ti is given to the fuel injection valve 6 to perform injection of the fuel.

Figure 4:
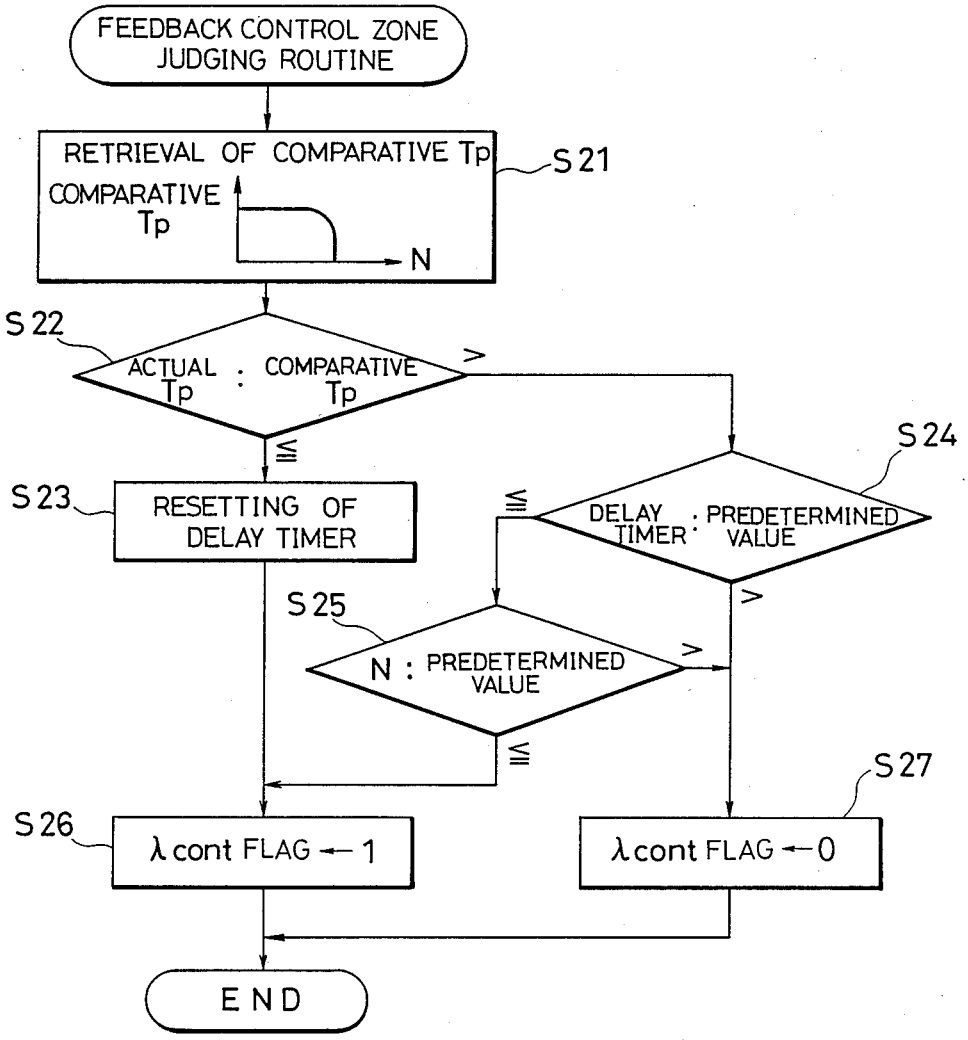
FIG. 4 is a flow chart showing the feedback control zone judging routine.

FIG. 4 shows the feedback control zone judging routine, which is disposed in principle for performing the air/fuel feedback control in the low-rotation low-load region (hatched region in FIG. 10) and for stopping the air/fuel feedback control in the high-rotation or high-load region.

At step 21, comparative Tp is retrieved from the engine rotation number N, and at step 22, the actual fuel injection quantity Tp (actual Tp) is compared with comparative Tp.

In cases when actual Tp$\leqq$comparative Tp, that is, in cases in the low-rotation low-load region, the routine goes into step 23 and a delay timer (counting up by a clock signal) is reset, and the routine goes into step 26 the $\lambda$ controlling flag is set at 1. This is for performing the air/fuel ratio feedback control in case of the low-rotation low-load region. Accordingly, the portion of steps 21 and 22 corresponds to the air/fuel ratio feedback control region detecting means for discriminating the engine driving state; detecting the air/fuel ratio feedback control region, which is the low-rotation low-load region; and outputting air/fuel ratio feedback control instructions.

In cases where actual Tp$>$comparative Tp, that is, at a high rotation or high load, in principle, the routine goes into step 27 and the $\lambda$ controlling flag is set at 0. This is for stopping the air/fuel ratio feedback control and obtaining a rich output air/fuel ratio so as to control the elevation of the exhaust temperature and prevent seizure of the engine 1 and burning of the catalyst 12.

Incidentally, even at a high rotation or high load, by comparing the value of the delay timer with the predetermined value at step 24, the routine goes into step 26 to keep the $\lambda$ controlling flag set at 1 for a predetermined time (for example, 10 seconds) after shifting to the high-rotation or high-load region, whereby the air/fuel ratio feedback control is continued for this predetermined time. This is for increasing the opportunity of learning of the indiscriminate learning correction coefficient $K_{ALT}$ because mountain climbing is performed in the high-load region. Accordingly, the portion of step 24 corresponds to the delay means for continuing to output the air/fuel ratio feedback control instructions for a predetermined time when the air/fuel ratio feedback control region shifts to the other region.

Incidentally, in a case where the judgment at step 25 indicates that the engine rotation number N exceeds a predetermined value (for example, 3800 rpm) or in a case where this excess is continued for a predetermined time, the air/fuel ratio feedback control is stopped for safety's sake.

Figure 5:
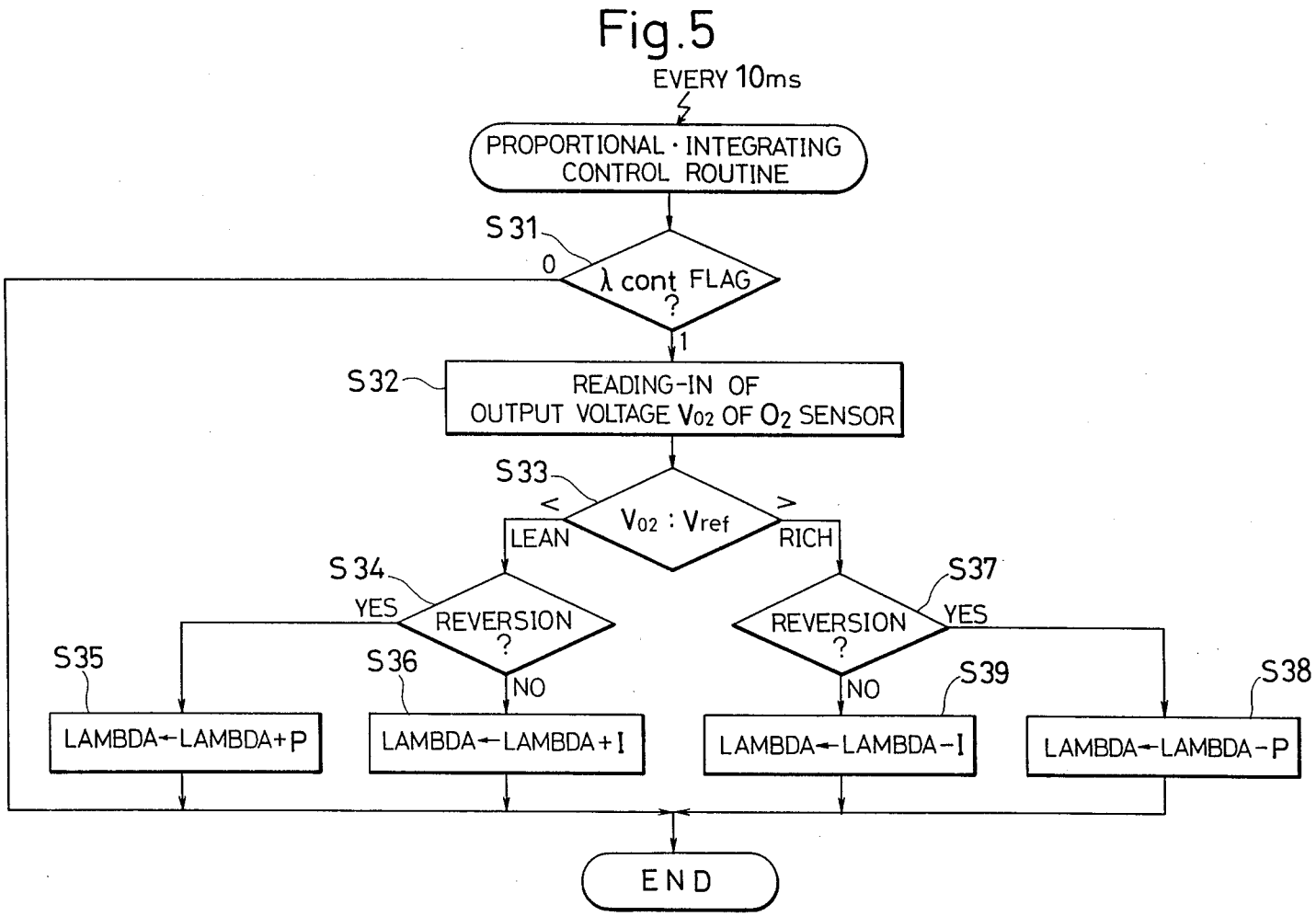
FIG. 5 is a flow chart showing the proportional-integrating control routine.

FIG. 5 shows the proportional-integrating routine, and the processing of this routine is performed at predetermined intervals (for example, 10 ms), whereby the feedback correction coefficient LAMBDA is set. Accordingly, this routine corresponds to the feedback correction coefficient setting means.

At step 31, the value of the λ controlling flag is judged, and if this such value is 0, this routine is ended. In this case, the feedback correction coefficient LAMBDA is clamped to precedent value (or the reference value of 1), and the air/fuel ratio feedback control is stopped.

In a case where the value of λ controlling flag is 1, the routine goes into step 32 and the output voltage $V_{02}$ of the $O_2$ sensor is read in, and at subsequent step 33, the output voltage $V_{02}$ is compared with the slice level voltage $V_{ref}$ corresponding to the theoretical air/fuel ratio, and it is judged whether the air/fuel ratio is rich or lean.

In the case where the air/fuel ratio is lean ($V_{02}<V_{ref}$), the routine goes into step 34 from step 33, it is judged whether or not the rich value is reversed to the lean value (just after the reversion), and when the reversion is judged, the routine goes into step 35 and the precedent value of the feedback correction coefficient LAMBDA is increased by the predetermined proportional constant P to obtain the present valve. When any case other than the reversion is judged, the routine goes into step 36, the precedent value of the feedback correction coefficient LAMBDA is increased by the predetermined integration constant I to obtain the present valve. Thus, the feedback correction coefficient LAMBDA is increased at a certain gradient. Incidentally, the relation of $P>>I$ is established.

In the case where the air/fuel ratio is rich ($V_{02}>V_{ref}$), the routine goes into step 37 from step 33 and it is judged whether the lean value is reversed to the rich value (just after the reversion), and when the reversion is judged, the routine goes into step 38 and the precedent value of the feedback correction coefficient LAMBDA is decreased by the predetermined proportional constant P. When any case other than the reversion is judged, the precedent value of the feedback correction coefficient LAMBDA is decreased by the integration constant I. Thus, the feedback correction coefficient LAMBDA is decreased at a certain gradient.

Figure 6:
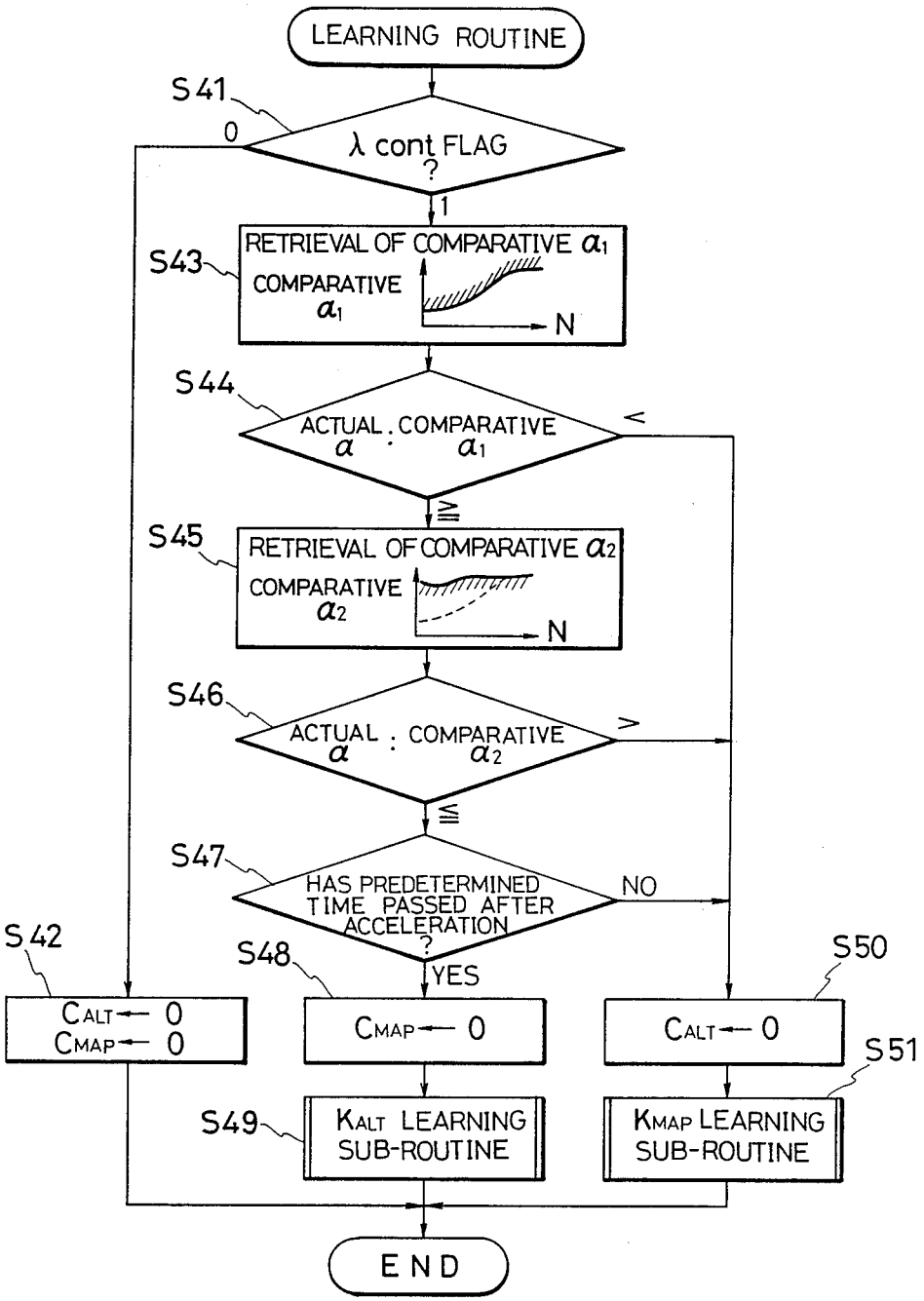
FIG. 6 is a flow chart showing the learning routine.
Figure 7:
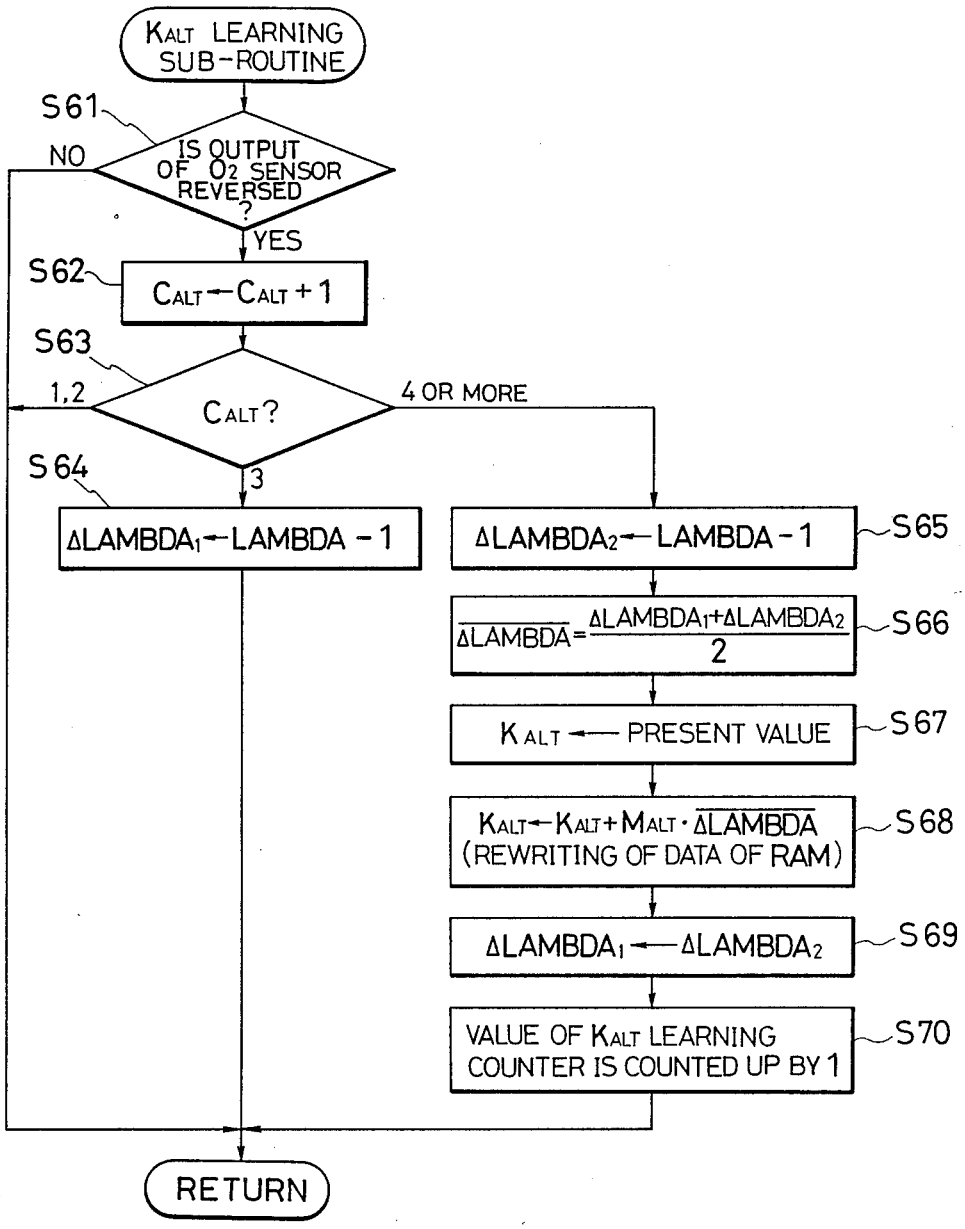
FIG. 7 is a flow chart showing the $K_{ALT}$ learning subroutine in FIG. 6.
Figure 8:
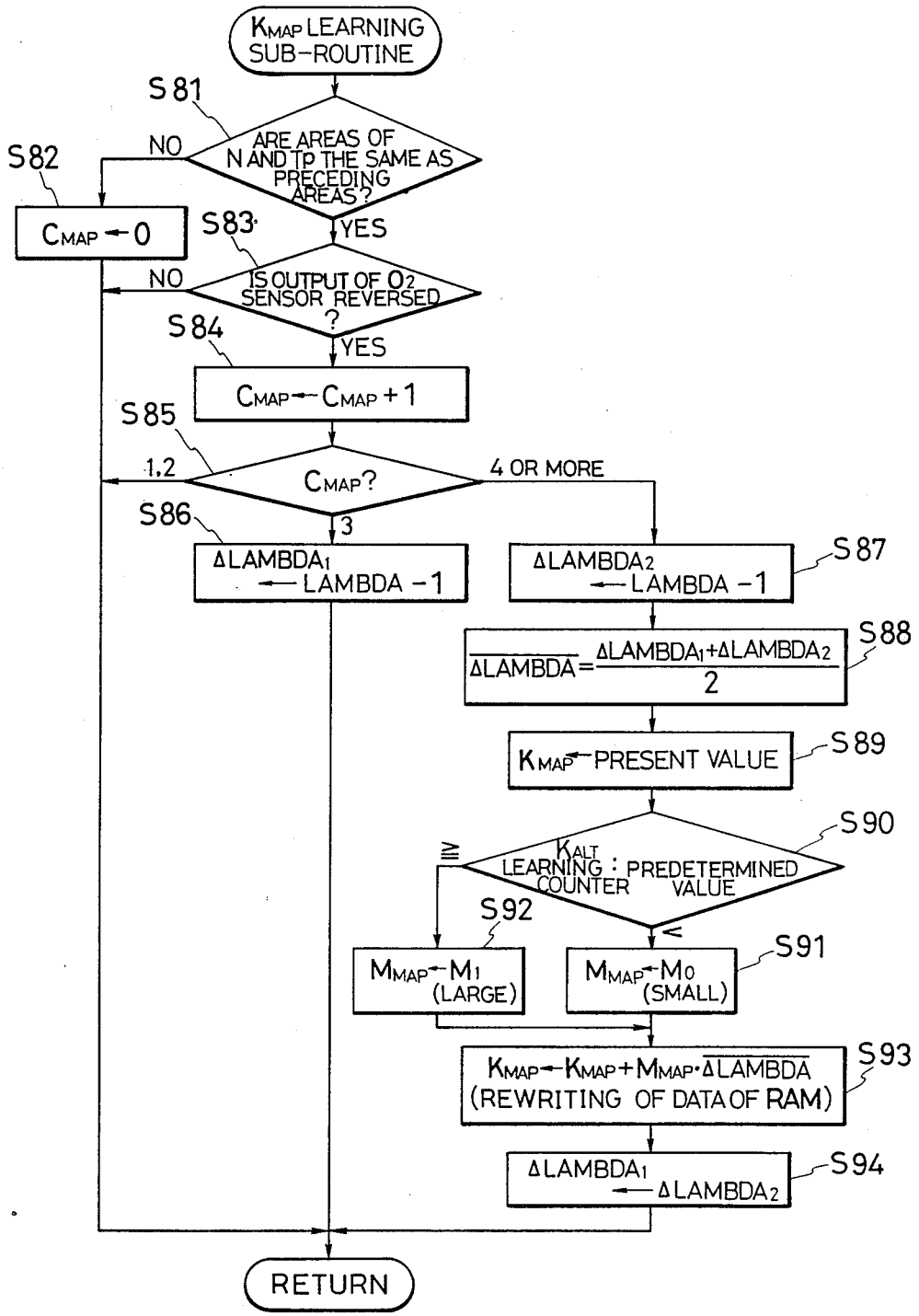
FIG. 8 is a flow chart showing the $K_{MAP}$ learning subroutine in FIG. 6.
Figure 9:
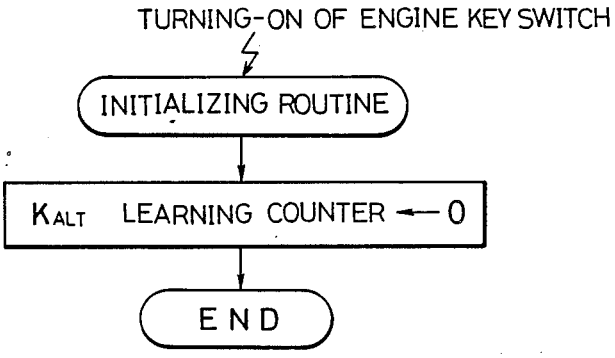
FIG. 9 is a flow chart showing the initializing routine.

FIG. 6 shows the learning routine, FIG. 7 shows the $K_{ALT}$ learning sub-routine, and FIG. 8, shows the $K_{MAP}$ learning sub-routine.

At step 41 in FIG. 6, the value of the λ controlling flag is judged, and when this value is 0, the routine goes into step 42 and count value $C_{ALT}$ and $C_{MAP}$ are cleared. Thus, the routine is ended. The reason for this is that when the air/fuel feedback control is stopped, learning cannot be performed.

In a case where the value of the λ controlling flag is 1, that is, during the air/fuel ratio feedback control, the routine goes into step 43 and subsequent steps, changeover is effected between the learning of the indiscriminate learning correction coefficient $K_{ALT}$ (hereinafter referred to a "$K_{ALT}$ learning") and the learning of the area-wise learning correction coefficient $K_{MAP}$ (hereinafter referred to as "$K_{MAP}$ learning").

More specifically, the $K_{ALT}$ learning is preferentially performed in the Q flat region (hatched region in FIG. 11) where the sucked air quantity Q is hardly changed by the change of the throttle valve opening degree α at each engine rotation number N, and the $K_{MAP}$ learning is performed in the other region. Accordingly, at step 43, the comparative value $\alpha_1$ is retrieved from the engine rotation number N, and at step 44, the actual throttle valve opening degree α (actual α) is compared with comparative $\alpha_1$. The portion of steps 43 and 44 corresponds to the indiscriminate learning region detecting means.

In a case where actual α≧comparative $\alpha_1$ (Q flat region), the routine goes, in principle, into steps 48 and 49, and the count value $C_{MAP}$ is cleared and the processing is carried out along the $K_{ALT}$ learning sub-routine.

However, in a case of the single-point injection system, in the region where the opening degree of the throttle valve 5 is very large, the flow rate of sucked air is reduced and the distribution of the fuel to the respective cylinders is worsened. Accordingly, the distribution-worsening region is allocated according to the opening degree of the throttle valve relatively to the engine rotation number, and if the throttle valve opening degree exceeds this critical level, the $K_{ALT}$ learning is inhibited. Accordingly, at step 45, comparative $\alpha_2$ is retrieved from the engine rotation number N, and the step 46, actual α is compared with comparative $\alpha_2$ and in case of actual α>comparative $\alpha_2$, the routine goes into steps 50 and 51 and the count value $C_{ALT}$ is cleared. Then, the routine is changed over to the $K_{MAP}$ learning subroutine shown in FIG. 8.

In case of the single-point injection system, since the distance between the fuel injection valve 6 and the combustion chamber of the engine 1 is long and the air/fuel ratio in each cylinder is disturbed by the influence of the fuel flowing on the wall during high acceleration, precise $K_{ALT}$ learning is impossible. Therefore, in the case where the engine driving state goes into the Q flat region after high acceleration, the $K_{ALT}$ learning is carried out after lapse of a predetermined time, that is, after the fuel flow becomes stationary. Accordingly, at step 47, it is judged whether or not a predetermined time has passed from the point of acceleration, and when it is judged that the predetermined time has not passed, the routine goes into steps 50 and 51 and the count value $C_{ALT}$ is cleared. Then, the routine is changed over to the $K_{MAP}$ learning sub-routine shown in FIG. 8. Incidentally, the acceleration is detected based on the change ratio of the throttle valve opening degree α detected based on the signal from the throttle sensor 15 or based on on-to-off changeover of the idle switch 16.

The portion of step 45, 46 and 47 corresponds to the indiscriminate learning inhibiting means.

In the case where actual α<comparative $\alpha_1$ is judged at step 44, the routine goes into steps 50 and 51, and the count value $C_{ALT}$ is cleared and the routine is changed over to the $K_{MAP}$ learning sub-routine shown in FIG. 8.

The $K_{ALT}$ learning sub-routine shown in FIG. 7 will now be described. This $K_{ALT}$ learning sub-routine corresponds to the indiscriminate learning correction coefficient modifying means.

At step 61, it is judged whether or not the output of the $O_2$ sensor 20 is reversed, that is, whether or not the increase or decrease direction of the feedback correction coefficient LAMBDA is reversed. When this subroutine is reversed repeatedly, the count value $C_{ALT}$ indicating the frequency of reversion is counted up by 1 at step 62. When $C_{ALT}$ becomes, for example, equal to 3, the routine goes into step 64 from step 63, and the deviation (LAMBDA − 1) of the present feedback correction coefficient LAMBDA from the reference value of 1 is temporarily stored as $\Delta LAMBDA_1$ and learning is initiated.

Figure 12:
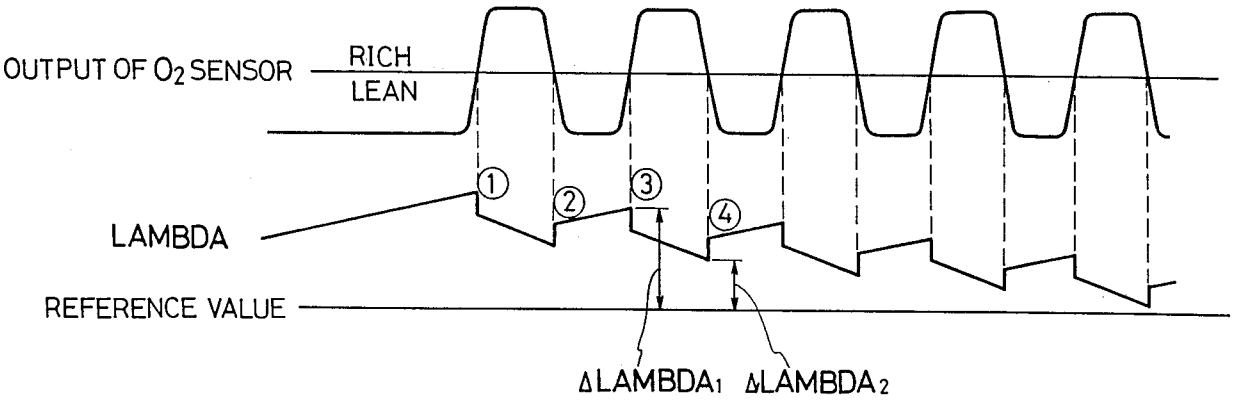
FIG. 12 is a diagram illustrating the change of the feedback correction coefficient.

When $C_{ALT}$ becomes 4 or more, the routine goes into step 65 from step 63, and the deviation (LAMBDA − 1) of the present feedback correction coefficient LAMBDA from the reference value of 1 is temporarily as $\Delta LAMBDA_2$. As shown in FIG. 12, thus stored $\Delta LAMBDA_1$ and $\Delta LAMBDA_2$ are upper and lower peak values of the deviation of the feedback correction coefficient LAMBDA from the reference value of 1 during the period from the preceding reversion (for example, the third reversion) to the present reversion (for example, the fourth reversion).

When the upper and lower peak values $\Delta LAMBDA_1$ and $\Delta LAMBDA_2$ of the feedback correction coefficient LAMBDA from the reference value of 1 are thus determined, the routine goes into step 66 and average value $\overline{\Delta LAMBDA}$ is determined according to the following formula:

$$\overline{\Delta LAMBDA} = (\Delta LAMBDA_1 + \Delta LAMBDA_2)/2.$$

Then, the routine goes into step 67 and the present indiscriminate learning correction coefficient $K_{ALT}$ (initial value=0) stored at a predetermined address of RAM is read out.

Then, the routine goes into step 68 and a new indiscriminate learning correction coefficient $K_{ALT}$ is computed by adding a predetermined proportion of the average value $\overline{\Delta LAMBDA}$ of the deviation of the feedback correction coefficient from the reference value to the present indiscriminate learning correction coefficient $K_{ALT}$, and the data of the indiscriminate learning correction coefficient at the predetermined address of RAM is modified and rewritten as indicated by the following formula:

$$K_{ALT} \leftarrow K_{ALT} + M_{ALT}\overline{\Delta LAMBDA}$$

wherein $M_{ALT}$ stands for the addition proportion constant, which is in the range of $0 < M_{ALT} < 1$.

Then, at step 69, $\Delta LAMBDA_2$ is substituted for $\Delta LAMBDA_1$ for subsequent learning.

Then, at step 70, the value of the $K_{ALT}$ learning counter is counted up by 1. Incidentally, the $K_{ALT}$ learning counter is set at 0 by the initializing routine shown in FIG. 9, which is carried out when the engine key switch 22 (or the start switch) is turned on, and this counter counts the frequency of learning after turning-on of the engine key switch 22.

The $K_{MAP}$ learning sub-routine shown in FIG. 8 will now be described. This $K_{MAP}$ learning sub-routine corresponds to the area-wise learning correction coefficient modifying means.

At step 81, it is judged whether or not the engine rotation number N and basic fuel injection quantity Tp, both indicating the engine driving state, are in the same area s the preceding area. In the case where the area is changed, the routine goes into step 82 and the count value $C_{MAP}$ is cleared. Thus, this sub-routine is ended.

In the case where it is judged that the area is the same as the preceding area, at step 83 it is judged whether or not the output of the $O_2$ sensor 20 is reversed, that is, whether or not the increase or decrease direction of the feedback correction coefficient LAMBDA is reversed. Every time this sub-routine is reversed repeatedly, the count value $C_{MAP}$ indicating the frequency of reversion is counted up by 1 at step 84. When the value of $C_{MAP}$ becomes equal to, for example, 3, the routine goes into step 86 from step 85, and the deviation (LAMBDA − 1) of the present feedback correction coefficient LAMBDA from the reference value of 1 is temporarily stored as $\Delta LAMBDA_1$ and learning is initiated.

When the value of $C_{MAP}$ becomes 4 or more, the routine goes into step 87 from step 85, and the deviation (LAMBDA − 1) of the present feedback correction coefficient LAMBDA from the reference value of 1 is temporarily stored as $\Delta LAMBDA_2$.

When the upper and lower peak values $\Delta LAMBDA_1$ and $\Delta LAMBDA_2$ of the deviation of the feedback correction coefficient LAMBDA from the reference value of 1 are thus determined, the routine goes into step 88 and the average value $\overline{\Delta LAMBDA}$ is calculated.

Then, the routine goes into step 89, and the stored area-wise learning correction coefficient $K_{MAP}$ (the initial value is 0) corresponding to the present area in the map on RAM is retrieved and read out.

Then, the routine goes into step 90, the value of the $K_{ALT}$ counter is compared with the predetermined value, and when the value of the $K_{ALT}$ counter is smaller than the predetermined value, the addition proportion constant (weighting constant) $M_{MAP}$ is set at relatively small value $M_0$ including the minimum value of 0 at step 91. On the other hand, when the value of the $K_{ALT}$ counter is equal to or larger than the predetermined value, the addition proportion constant (weighting constant) $M_{MAP}$ is set at a relatively large value $M_1$. Incidentally, the relation of $M_1 << M_{ALT}$ is established.

Then, the routine goes into step 93, and a new area-wise learning correction coefficient $K_{MAP}$ is computed by adding a proportion, determined by the addition proportion constant $M_{MAP}$, of the average value $\overline{\Delta LAMBDA}$ of the deviation of the feedback correction coefficient from the reference value to the present area-wise learning correction coefficient $K_{MAP}$ according to the following formula:

$$K_{MAP} \leftarrow K_{MAP} + M_{MAP}\overline{\Delta LAMBDA}$$

and the data of the area-wise learning correction coefficient of the same area of the map on RAM is modified and rewritten.

At step 94, $\Delta LAMBDA_2$ is substituted for $\Delta LAMBDA_1$ for the subsequent learning.

The reason why the requirement of $M_{ALT} >> M_{MAP}$ is set with respect to the addition proportion constant (weighting constant) is that the $K_{ALT}$ learning is preferentially performed by imposing a large weight on the learned value in modifying the indiscriminate learning correction coefficient $K_{ALT}$ and imposing a small weight on the learned value in modifying the area-wise learning correction coefficient $K_{MAP}$, since the $K_{ALT}$ learning is first carried out and the area-wise $K_{MAP}$ learning is then performed.

The reason why the value of $M_{MAP}$ is changed according to the frequency of the $K_{ALT}$ learning after turning-on of the engine key switch 22 (or the start switch) is that advance of the $K_{MAP}$ learning is controlled before the $K_{ALT}$ learning is experienced and in the extreme case, $M_{MAP}$ is set at 0 to inhibit the $K_{MAP}$ learning.

In the case where the $K_{ALT}$ learning is always made preferential to the $K_{MAP}$ learning in the above-mentioned manner, it becomes possible to prevent degradation of the driving and emission characteristics, which are caused by large gaps of the area-wise learning correction coefficient $K_{MAP}$ among the areas, which gaps are produced when the $K_{MAP}$ learning inclusive of learning of the deviation by the change of the air density is advanced only in limited areas without sufficient advance of the $K_{ALT}$ learning in the case where an automobile ascends to an upland by such driving that the driving state hardly enters into the Q flat region.

As should be apparent from the foregoing description, according to the present invention, since the deviation by the change of the air density is preferentially learned indiscriminately in the Q flat region, the deviation by the change of the air density can be learned at a high speed, and there can be attained an effect of performing good learning and control of the air/fuel ratio notwithstanding even deviation that may be caused by change in air density during mountain climbing or the like.

Furthermore, when the present invention is applied to the single-point injection system, there can be attained an effect of increasing the accuracy of learning while taking the characteristics of this system into consideration.

Moreover, according to the present invention, in case where the air/fuel ratio feedback control region which is the low-rotation low-load region shifts to the region where the air/fuel ratio feedback control is not performed, the air/fuel ratio feedback control is continued for a predetermined time to increase the opportunity of learning and sufficient chance is given to learning of the deviation by the change of the air density. Accordingly, there can be attained an effect of coping efficiently with the deviation by the change of the air density.

I claim:

1. An apparatus for learning and controlling an air/fuel ratio in an internal combustion engine, which comprises:

engine driving state detecting means for detecting an engine driving state including at least one area and at least one parameter having an impact on quantity of air sucked into said engine;

air/fuel ratio detecting means for detecting an exhaust component of said engine and thereby detecting air/fuel ratio in an air/fuel mixture sucked in said engine;

basic fuel injection quantity setting means for setting a basic fuel injection quantity based on said parameter detected by said engine driving state detecting means;

rewritable indiscriminate learning correction coefficient storing means which store therein an indiscriminate learning correction coefficient for indiscriminately correcting said basic fuel injection quantity for all of said areas of said engine driving state;

rewritable area-wise learning correction coefficient storing means which store therein an area-wise learning correction coefficient for correcting said basic fuel injection quantity for respective areas of said engine driving state;

area-wise learning correction coefficient retrieving means for retrieving an area-wise learning correction coefficient for a corresponding area of said engine driving state from said area-wise learning correction coefficient storing means based on actual engine driving state;

feedback correction coefficient setting means for comparing said air/fuel ratio detected by said air/fuel ratio detecting means with a desired air/fuel ratio and adjusting by a predetermined quantity a feedback correction coefficient for correcting said basic fuel injection quantity to bring actual air/fuel ratio close to said desired air/fuel ratio;

fuel injection quantity computing means for computing said fuel injection quantity based on said basic fuel injection quantity set by said basic fuel injection quantity setting means, said indiscriminate learning correction coefficient stored in said indiscriminate learning correction coefficient storing means, said area-wise learning correction coefficient retrieved by said area-wise learning correction coefficient retrieving means and the feedback correction coefficient set by said feedback correction coefficient setting means;

fuel injection means for injecting and supplying a fuel to said engine in an on-off manner according to a driving pulse signal corresponding to said fuel injection quantity computed by said fuel injection quantity computing means;

indiscriminate learning region detecting means for detecting a predetermined high load region of the engine where the sucked air flow quantity is not substantially changed based on the degree of openness of a throttle valve at each engine speed;

indiscriminate learning correction coefficient modifying means for, on detection of said predetermined region by said indiscriminate learning region detecting means, learning deviation of the feedback correction coefficient from a reference value and modifying and rewriting the indiscriminate learning correction coefficient storing means so as to reduce said deviation; and area-wise learning correction coefficient modifying means for, on non-detection of said predetermined region by said indiscriminate learning region detecting means, learning deviation of the feedback correction coefficient from a reference value for the respective areas of the engine driving state and modifying and rewriting the area-wise learning correction coefficient of said area-wise learning correction coefficient storing means so as to reduce said deviation.

2. An apparatus for learning and controlling an air/fuel ratio in an internal combustion engine according to claim 1, wherein the basic fuel injection quantity setting means is means for computing a basic fuel injection quantity Tp according to the relational formula of $Tp=K\cdot Q/N$ wherein Q stands for the sucked air flow quantity, N stands for the engine rotation number and K is a constant.

3. An apparatus for learning and controlling an air/fuel ratio in an internal combustion engine according to claim 2, wherein the engine driving state detecting means comprises means for detecting degree of openness of said throttle valve and means for detecting engine rotation number, and wherein the basic fuel injection quantity setting means comprises means for estimating quantity of air flow sucked into said engine based upon said degree of openness of said throttle valve and said engine rotation number.

4. An apparatus for learning and controlling an air/fuel ratio in an internal combustion engine according to claim 1, wherein the area-wise learning correction coefficient storing means stores the area-wise learning correction coefficient for each of areas sorted according to engine rotation number and basic fuel injection quantity.

5. An apparatus for learning and controlling an air/fuel ratio in an internal combustion engine according to claim 1, wherein the fuel injection quantity computing means comprises means for computing a fuel injection quantity Ti according to the relational formula of $Ti = Tp$ (LAMBDA + $K_{ALT}$ + $K_{MAP}$) wherein Tp stands for the basic fuel injection quantity, $K_{ALT}$ stands for the indiscriminate learning correction coefficient, $K_{MAP}$ stands for the area-wise learning correction coefficient and LAMBDA stands for the feedback correction coefficient.

6. An apparatus for learning and controlling an air/fuel ratio in an internal combustion engine according to claim 1, wherein said indiscriminate learning region detecting means comprises a throttle valve degree of openness detecting means for detecting an actual throttle valve degree of openness, and means for retrieving a comparative value of said throttle valve degree of openness determined according to engine rotation number, comparing the actual throttle valve degree of openness with the comparative value and detecting the indiscriminate learning region wherein the actual throttle valve degree of openness is larger than the comparative value.

7. An apparatus for learning and controlling an air/fuel ratio in an internal combustion engine according to claim 1, wherein the indiscriminate learning correction coefficient modifying means and area-wise learning correction coefficient modifying means is means for renewing the indiscriminate learning correction coefficient and area-wise learning correction coefficient, respectively, according to the renewal formulae of $K_{ALT} \leftarrow K_{ALT} + M_{ALT} \cdot \Delta$LAMBDA and $K_{MAP} \leftarrow K_{MAP} + M_{MAP} \cdot \Delta$LAMBDA wherein $K_{ALT}$ stands for the indiscriminate learning correction coefficient, $K_{MAP}$ stands for the area-wise learning correction coefficient, ΔLAMBDA stands for the deviation of the feedback correction coefficient from the reference value, and $M_{ALT}$ and $M_{MAP}$ stands for predetermined addition proportions.

8. An apparatus for learning and controlling an air/fuel ratio in an internal combustion engine according to claim 7, wherein said relation of $M_{ALT > MMAP}$ is established between said addition proportion $M_{ALT}$ in said indiscriminate learning correction coefficient modifying means and said addition proportion $M_{MAP}$ in said area-wise learning correction coefficient modifying means.

9. An apparatus for learning and controlling an air/fuel ratio in an internal combustion engine according to claim 7, wherein said addition proportion $M_{MAP}$ in said area-wise learning correction coefficient modifying means is variable according to the frequency of rewriting of said indiscriminate learning correction coefficient by said indiscriminate learning correction coefficient modifying means after turning-on of an engine key switch.

10. An apparatus for learning and controlling an air/fuel ratio in an internal combustion engine, which comprises:

engine driving state detecting means for detecting an engine driving state including at least one area and at least one parameter having an impact on quantity of air sucked into said engine;

air/fuel ratio detecting means for detecting an exhaust component of said engine and thereby detecting air/fuel ratio in an air/fuel mixture sucked into said engine;

basic fuel injection quantity setting means for setting a basic fuel injection quantity based on said parameter detected by said engine driving state detecting means;

rewritable indiscriminate learning correction coefficient storing means which store therein an indiscriminate learning correction coefficient for indiscriminately correcting said basic fuel injection quantity for all of areas of said engine driving state;

rewritable area-wise learning correction coefficient storing means which store therein an area-wise learning correction coefficient for correcting said basic fuel injection quantity for respective areas of said engine driving state;

area-wise learning correction coefficient retrieving means for retrieving an area-wise learning correction coefficient for a corresponding area of said engine driving state from said area-wise learning correction coefficient storing means based on actual engine driving state;

feedback correction coefficient setting means for comparing said air/fuel ratio detected by said air/fuel ratio detecting means with a desired air/fuel ratio and adjusting by a predetermined quantity a feedback correction coefficient for correcting said basic fuel injection quantity to bring actual air/fuel ratio close to said desired air/fuel ratio;

fuel injection quantity computing means for computing said fuel injection quantity based on said basic fuel injection quantity set by said basic fuel injection quantity setting means, said indiscriminate learning correction coefficient stored in said indiscriminate learning correction coefficient storing means, said area-wise learning correction coefficient retrieved by said area-wise learning correction coefficient retrieving means and said feedback correction coefficient set by said feedback correction coefficient setting means;

fuel injection means for injecting and supplying the engine in an on-off manner according to a driving pulse signal corresponding to the fuel injection quantity computed by said fuel injection quantity computing means;

indiscriminate learning region detecting means for detecting a predetermined region where the sucked air flow quantity is not substantially changed according to the change of the degree of openness of the throttle valve at each engine rotation number;

indiscriminate learning correction coefficient modifying means for, on detection of said predetermined region by said indiscriminate learning region detecting means, learning the deviation of the feedback correction coefficient from a reference value and modifying and rewriting the indiscriminate learning correction coefficient of said indiscriminate learning correction coefficient storing means so as to reduce said deviation;

area-wise learning correction coefficient modifying means for, on non-detection of said predetermined region by said indiscriminate learning region detecting means, learning the deviation of the feedback correction coefficient from a reference value for the respective areas of the engine driving state and modifying and rewriting the area-wise learning correction coefficient of said area-wise learning correction coefficient storing means so as to reduce said deviation; and indiscriminate learning inhibiting means for inhibiting the learning by the indiscriminate learning correction coefficient modifying means in a predetermined engine driving state.

11. An apparatus for learning and controlling an air/fuel ratio in an internal combustion engine according to claim 10, wherein the indiscriminate learning inhibiting means comprises means for detecting a region where distribution of fuel into a respective cylinder is worsened, which is predetermined by said engine rotation number and degree of openness of said throttle valve, and inhibiting the learning by said indiscriminate learning correction coefficient modifying means in said region.

12. An apparatus for learning and controlling an air/fuel ratio in an internal combustion engine according to claim 10, wherein said indiscriminate learning inhibiting means comprises means for inhibiting learning by said indiscriminate learning correction coefficient modifying means for a predetermined time after acceleration.

13. An apparatus for learning and controlling an air/fuel ratio in an internal combustion engine, which comprises:

engine driving state detecting means for detecting an engine driving state including at least one area and at least one parameter having an impact on quantity of air sucked into said engine;

air/fuel ratio detecting means for detecting an exhaust component of said engine and thereby detecting air/fuel ratio in an air/fuel mixture sucked into said engine;

basic fuel injection quantity setting means for setting a basic fuel injection quantity based on said parameter detected by said engine driving state detecting means;

rewritable indiscriminate learning correction coefficient storing means which store therein an indiscriminate learning correction coefficient for indiscriminately correcting said basic fuel injection quantity for all of said areas of said engine driving state;

rewritable area-wise learning correction coefficient storing means which store therein an area-wise learning correction coefficient for correcting said basic fuel injection quantity for respective areas of said engine driving state;

area-wise learning correction coefficient retrieving means for retrieving an area-wise learning correction coefficient for a corresponding area of said engine driving state from said area-wise learning correction coefficient storing means based on actual engine state;

air/fuel ratio feedback control region detecting means for detecting the air/fuel ratio control region which is the low-rotation number low-load region and outputting air/fuel feedback control instructions;

delay means for continuing to output air/fuel ratio feedback control instructions for a predetermined time after the air/fuel ratio feedback control region shifts to other region;

feedback correction coefficient setting means for comparing the air/fuel ratio detected by said air/fuel ratio detecting means with a desired air/fuel ratio while said air/fuel ratio feedback control instructions are being output and adjusting by a predetermined quantity a feedback correction coefficient for correcting said basic fuel injection quantity to bring said actual air/fuel ratio close to said desired air/fuel ratio;

fuel injection quantity computing means for computing said fuel injection quantity based on said basic fuel injection quantity set by said basic fuel injection quantity setting means, said indiscriminate learning correction coefficient stored in said indiscriminate learning correction coefficient storing means, said area-wise learning correction coefficient retrieved by said area-wise learning correction coefficient retrieving means and said feedback correction coefficient set by said feedback correction coefficient setting means;

fuel injection means for injecting and supplying a fuel to said engine in an on-off manner according to a driving pulse signal corresponding to said fuel injection quantity computed by said fuel injection quantity computing means;

indiscriminate learning region detecting means for detecting a predetermined region where the sucked air flow quantity is not substantially changed according to the change of the degree of openness of said throttle valve at each engine rotation number;

indiscriminate learning correction coefficient modifying means for, on detection of said predetermined region by said indiscriminate learning region detecting means while said air/fuel ratio feedback control instructions are being output, learning the deviation of the feedback correction coefficient from a reference value and modifying and rewriting the indiscriminate learning correction coefficient of said indiscriminate learning correction coefficient storing means so as to reduce said deviation; and area-wise learning correction coefficient modifying means for, on non-detection of said predetermined region by said indiscriminate learning region detecting means while said air/fuel ratio feedback control instructions are being output, learning the deviation of the feedback correction coefficient from a reference value for the respective areas of the engine driving state and modifying and rewriting the area-wise learning correction coefficient of said area-wise learning correction coefficient storing means so as to reduce said deviation.

* * * * *

UNITED STATES PATENT AND TRADEMARK OFFICE
CERTIFICATE OF CORRECTION

PATENT NO. : 4,850,326

DATED : July 25, 1989

INVENTOR(S) : Naoki TOMISAWA

It is certified that error appears in the above-identified patent and that said Letters Patent is hereby corrected as shown below:

In the Abstract, line 6, change "air/ful" to ——air/fuel——.

At column 1, line 15, delete [the] after "with".

At column 3, line 23, change "of" to ——or—— after "part".

At column 5,line 13, change "pule" to ——pulse——.

At column 7, line 23, change "illustrate" to ——illustrates——.

At column 8, line 16, change "to" to ——the—— after "control".

At column 8,line 60, change "routine" to ——routine)—— after "initializing".

At column 8, line 61, change "detail" to ——detailed——.

At column 9, line 38, change "ration" to ——ratio——.

At column 9, line 44, change "(1)" to ——1)——.

At column 10, line 7, insert ——is—— after "101".

At column 10, line 68, delete [,] after "means".

At column 12, line 28, change "when" to ——where——.

At column 12, line 31, insert ——and—— after "26".

At column 14, line 37, insert ——amount of—— after "predetermined".

At column 15, line 7, insert ——stored—— after "temporarily".

At column 15, line 58, change "s" to ——as——.

At column 16, line 24, insert ——a—— after "at".

At column 19, line 45 (claim 8, line 3) change "MMAP" to ——$M_{MAP}$——.

At column 20, line 11 (claim 10, line 20), insert ——said——before "areas".

UNITED STATES PATENT AND TRADEMARK OFFICE

CERTIFICATE OF CORRECTION

PATENT NO. : 4,850,326

DATED : July 25, 1989

INVENTOR(S) : Naoki TOMISAWA

It is certified that error appears in the above-identified patent and that said Letters Patent is hereby corrected as shown below:

At column 20, line 42 (claim 10, line 51), insert ---a fuel to paths in--- before "the".

Signed and Sealed this

Third Day of September, 1991

*Attest:*

HARRY F. MANBECK, JR.

*Attesting Officer*

*Commissioner of Patents and Trademarks*